US006677704B2

(12) United States Patent
Ishimoto et al.

(10) Patent No.: US 6,677,704 B2
(45) Date of Patent: Jan. 13, 2004

(54) AC-TYPE GAS DISCHARGE DISPLAY WITH ELLIPTICAL DISCHARGE TUBE

(75) Inventors: Manabu Ishimoto, Kobe (JP); Tsutae Shinoda, Akashi (JP); Akira Tokai, Kakogawa (JP); Hitoshi Yamada, Akashi (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/051,104

(22) Filed: Jan. 22, 2002

(65) Prior Publication Data

US 2003/0042839 A1 Mar. 6, 2003

(30) Foreign Application Priority Data

Aug. 28, 2001 (JP) ..... 2001-258571

(51) Int. Cl.[7] ..... H01J 1/62

(52) U.S. Cl. ..... 313/493; 313/582; 313/634; 313/594

(58) Field of Search ..... 313/582, 493, 313/594, 634

*Primary Examiner*—Vip Patel
(74) *Attorney, Agent, or Firm*—Staas & Halsey LLP

(57) ABSTRACT

An AC-type gas discharge display includes a base, discharge tubes which are arranged on the base in parallel to each other and which contain fluorescent phosphors, data electrodes formed on the external surfaces of the discharge tubes such that the data electrodes extend in the longitudinal direction of the discharge tubes, and display electrodes formed in pairs on the external surfaces of the discharge tubes at the opposite side of the data electrodes such that the display electrodes intersect the discharge tubes. Each of the discharge tubes has a flattened elliptical shape in cross-section thereof and includes a pair of flat portions. The data electrodes are formed on one of the flat portions and scanning electrodes and common electrodes are alternately arranged on the other one of the flat portions, and the discharge tubes are supported by the base at one or the other one of the flat portions.

20 Claims, 8 Drawing Sheets

AC-TYPE GAS DISCHARGE DISPLAY WITH ELLIPTICAL DISCHARGE TUBE

BACKGROUND OF THE INVENTION

1. Field of the Invention

The present invention relates to a display in which a plurality of fine discharge tubes, each of which is divided into sections which can individually emit light, are combined, and which utilizes electric discharge.

2. Description of the Related Art

A large display, in which a fluorescent phosphor is activated by ultraviolet rays generated by electric discharge so that visual light is emitted, and in which the size of the display can be freely designed, is disclosed in Japanese Unexamined Patent Application Publication No. 2000-315460. This display, which is shown in FIGS. 15 and 17 in the above-described publication, includes a plurality of display tubes (discharge tubes) arranged in parallel to each other and a substrate which support the discharge tubes. Each of the discharge tubes includes a glass tube into which a discharge gas is filled and island-shaped display electrodes are arranged on the external surface of the glass tube in the longitudinal direction of the glass tube. In addition, a long data electrode is disposed on the internal surface of the glass tube in such a manner that the data electrode opposes all the display electrodes. Two display electrodes which are adjacent to each other with a predetermined distance therebetween function as a pair of discharge electrodes for surface discharge. Island-shaped metal bus electrodes are arranged on the substrate in pairs in such a manner that the metal bus electrodes intersect the data electrodes, and the display tubes are disposed on the substrate in such a manner that the display electrodes individually contact the metal bus electrodes. Each metal bus electrode crosses, all the display tubes and connects the group of display electrodes which belong to the same level to each other. Thus, an electrode matrix is formed by the group of display electrodes and the group of data electrodes. An arbitrary image can be displayed by controlling the voltages supplied to the electrode matrix by a method similar to a voltage control method used in a typical three-electrode surface-discharge plasma display panel.

Through the development of the discharge tubes disclosed in the Japanese Unexamined Patent Application Publication No. 2000-315460, the inventors have found the following facts. A case is considered in which a display is constructed by arranging the display electrodes on the external surface of the discharge tubes and forming the metal bus electrodes through which voltages are supplied. If the display has low resolution, the positional relationship between the display electrodes and the metal bus electrodes does not cause a problem. However, if the display has high resolution, the accuracy of the positional relationship between the display electrodes and external electrodes is severe since pitch allowance between the electrodes are accumulated over the display area. For example, if 1000 display electrodes having a width of 300 $\mu$m are arranged with 1 mm pitch, the maximum allowance in the relative position may exceed the width of the electrodes unless the allowance in the relative position corresponding to a single electrode is 0.3 $\mu$m or less. Accordingly, there is a problem in that it is technically difficult, and a considerably high cost is incurred, to realize such a high positional accuracy.

In addition, when each of the discharge tubes has a circular shape in cross section, the distance between the discharge electrodes and the fluorescent phosphor is approximately the same as the inside diameter of the discharge tube. Thus, vacuum ultraviolet rays generated by electric discharge are absorbed by the discharge gas before they reach the fluorescent phosphor, thus reducing the luminous efficiency.

SUMMARY OF THE INVENTION

In order to solve the above-described problems, the inventors have invented a display which includes discharge tubes having an elliptical shape, and more preferably, a flattened elliptical shape, in cross section. Accordingly, the required positional accuracy can be reduced and the luminous efficiency can be improved.

According to one aspect of the present invention, an AC-type gas discharge display comprises a base; a plurality of discharge tubes which are arranged on the base in parallel to each other and which contain fluorescent phosphors; data electrodes formed on the external surfaces of the discharge tubes such that the data electrodes extend in the longitudinal direction of the discharge tubes; and display electrodes formed in pairs, in each of which one display electrode serves as a scanning electrode and the other display electrode serves as a common electrode, on the external surfaces of the discharge tubes at the opposite side from the data electrodes such that the display electrodes intersect the discharge tubes. Each of the discharge tubes has a flattened elliptical shape in cross-section thereof and includes a pair of flat portions. The data electrodes are formed on one of the flat portions and the scanning electrodes and the common electrodes are alternately arranged on the other one of the flat portions, and the discharge tubes are supported by the base at one or the other one of the flat portions.

The wall thickness of each discharge tube is preferably 400 $\mu$m or less at least at one of the flat portions and a gas discharge occurs between adjacent pairs of display electrodes in each discharge tube via the corresponding part of the wall.

In addition, width of the flat portion of each discharge tube is preferably larger than 0.3 mm.

According to another aspect of the present invention, an AC-type gas discharge display comprises a discharge tube into which discharge gas is filled, which is provided with at least one pair of display electrodes on the external surface thereof, which includes a fluorescent layer on the internal surface thereof, and which emits visual light when a gas discharge occurs therein. The discharge tube has an elliptical shape in cross-section thereof, and the display electrodes are disposed on the external surface of the discharge tube such that the display electrodes extend in the direction of the major axis of the elliptical shape.

At least a part of the discharge tube is preferably formed as a flat portion and the display electrodes are preferably formed on the flat portion of the discharge tube.

In addition, the discharge tube preferably includes a pair of flat portions which, in cross sectional view, extend in the direction of the major axis of the elliptical shape while opposing each other.

In addition, in the cross-section of the discharge tube the ratio of the major axis to the minor axis is preferably in the range of 10:7 to 5:1.

In addition, the display electrodes are preferably formed on one of the flat portions, and a fluorescent phosphor layer is preferably formed over the other one of the flat portions and curved portions formed at both sides thereof.

In addition, the fluorescent phosphor layer is preferably formed on a fluorescent phosphor layer supporter and the fluorescent phosphor layer supporter is inserted into the discharge tube.

According to the present invention, since the discharge tubes have a flattened elliptical shape in cross section, the discharge tubes can be stably disposed on a base, and discharge electrodes can be reliably arranged over a large area. In addition, the luminance and the luminous efficiency can be increased.

DESCRIPTION OF THE PREFERRED EMBODIMENTS

First Embodiment

Figure 1A:
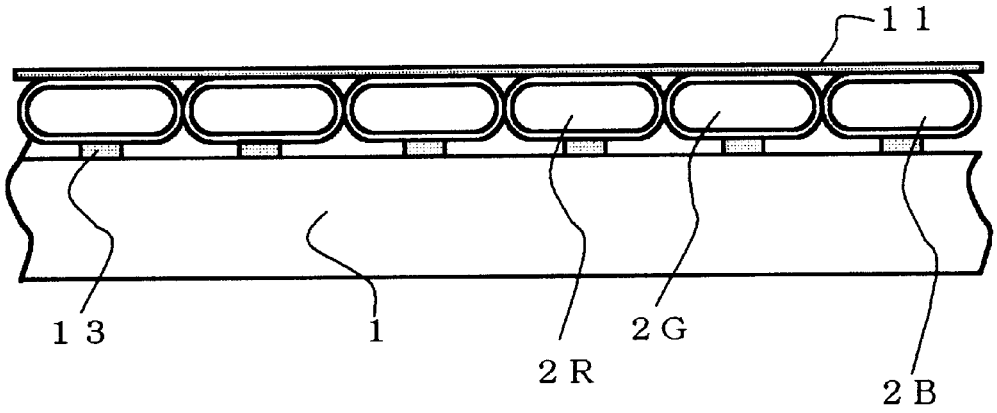
FIGS. 1A to 1C are diagrams showing a display according to a first embodiment of the present invention.
Figure 1B:
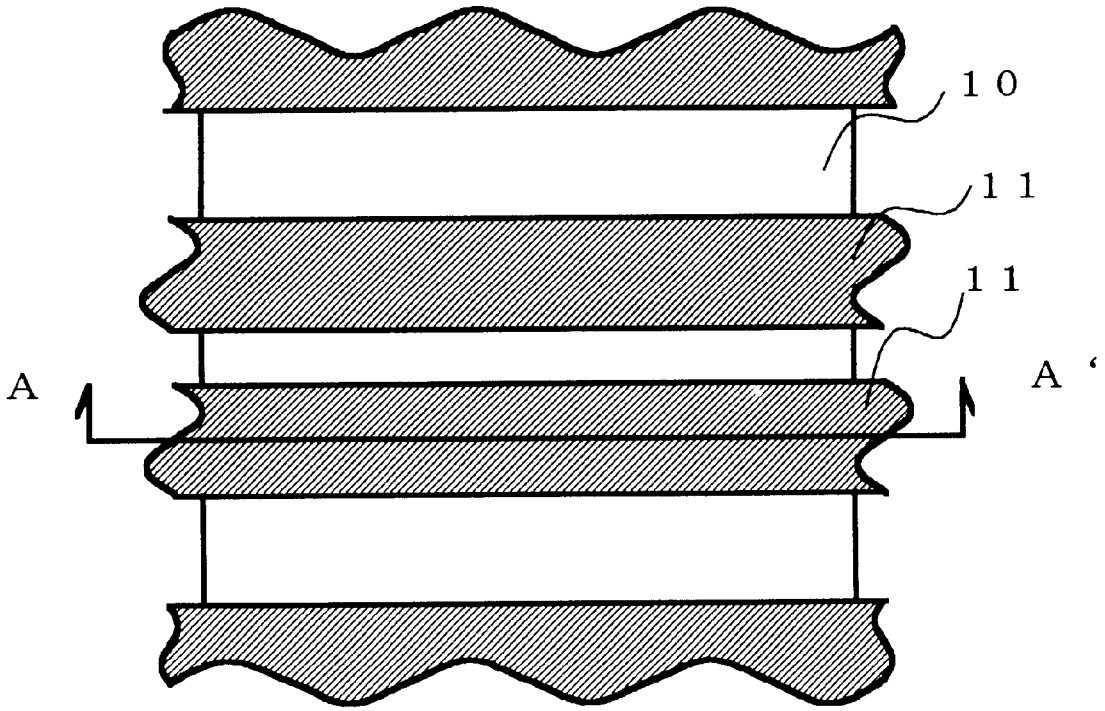
Figure 1C:
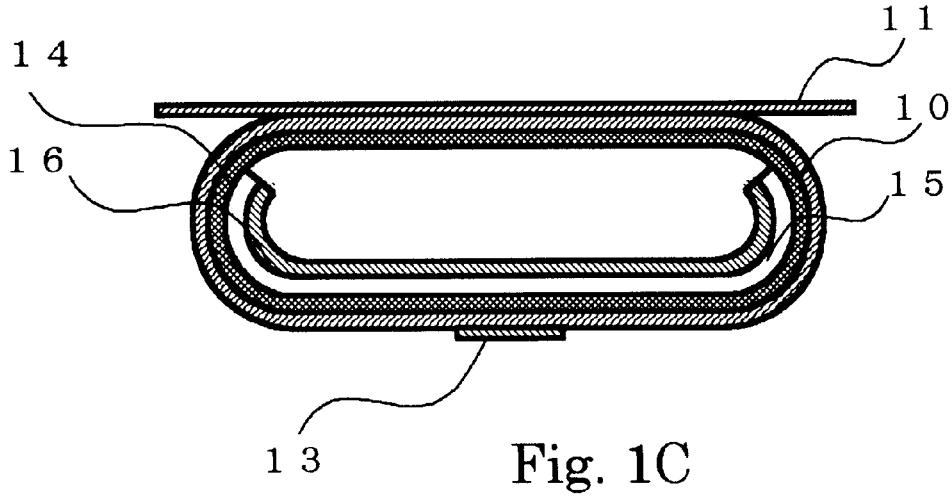

FIG. 1A is a sectional view of an AC-type gas discharge display according to a first embodiment of the present invention. In addition, FIGS. 1B and 1C are a plan view and a sectional view, respectively, for explaining the operation principle of a single discharge tube. Data electrodes 13 are formed on a base 1, and discharge tubes 2R, 2G, and 2B, which individually correspond to three primary colors, are superposed on the data electrodes 13. Display electrodes 11 are arranged in pairs at the other side of the data electrodes 13 in such a manner that the display electrodes 11 extend in the direction perpendicular to the data electrodes 13 and intersect the discharge tubes 2R, 2G, and 2B.

Each of the discharge tubes includes a glass tube, which has an elliptical shape in cross section. The display electrodes 11, which extend in the direction of the major axis of the elliptical shape, are disposed on the external surface of the glass tube as discharge electrodes. Electric discharge occurs when an alternating electric field is applied between two display electrodes 11 forming a pair. A secondary electron emitting film 14 is formed on the internal surface of the glass tube over the entire area thereof, and a fluorescent phosphor 16 is formed at the side opposite to the side at which the discharge electrodes are formed. The fluorescent phosphor 16 may be formed on a fluorescent phosphor layer supporter 15, or only the fluorescent phosphor 16 may be formed without applying the fluorescent phosphor layer supporter 15. In the case of using the fluorescent phosphor layer supporter 15, the fluorescent phosphor 16 is formed on the fluorescent phosphor layer supporter 15 and then the fluorescent phosphor layer supporter 15 is inserted into the discharge tube. However, it is important that the fluorescent phosphor 16 be disposed at a position such that the fluorescent phosphor 16 is not directly exposed to the electric discharge from the display electrodes 11. In addition, it is also important that at least parts which are exposed to the electric discharge be covered by the secondary electron emitting film 14 so that the discharge voltage is reduced. The glass tube containing the fluorescent phosphor 16 is provided with the data electrode 13, which extends in the direction perpendicular to the discharge electrodes and which is used for selecting the discharge electrodes, at the side at which the fluorescent phosphor 16 is formed. The data electrode 13 may be formed directly on the external surface of the glass tube, or on a base (see FIG. 1A) on which the glass tube is arranged. In the present embodiment, each of the discharge tubes has two flat portions which extend in the direction of the major axis in the cross-section thereof. However, the discharge tube may have no flat portion, or the discharge tube may have one flat portion at one side thereof. The discharge tube having such a flattened elliptical shape in cross-section can be obtained by first forming a tube in a cylindrical shape, and then pressing the tube between a pair of flat, parallel plates in a heated and softened state. Alternatively, the discharge tube may also be obtained by using a material having a flattened elliptical shape in cross-section in a drawing process.

Figure 5:
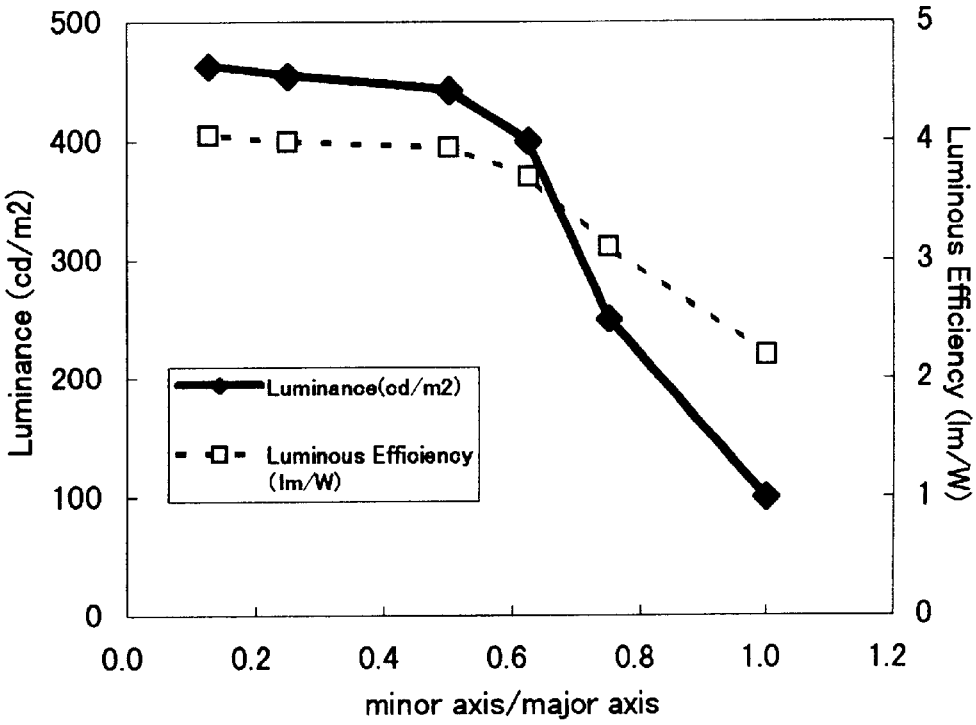
FIG. 5 is a graph showing the relationship between the ratio of the minor axis to the major axis in the cross-section of a glass tube and the luminance, and the relationship between the above-described ratio and the luminous efficiency.

Discharge tubes constructed as shown in FIGS. 1A to 1C, in which the inner length of the major axis in the cross-section of the glass tube was 0.8 mm and the inner length of the minor axis was varied, were prepared, and the luminance and the luminous efficiency thereof were measured. The results are shown in FIG. 5. The horizontal axis shows the ratio of the minor axis to the major axis, and the vertical axes show the luminance and the luminous efficiency. The solid line shows the luminance, and the dashed line shows the luminous efficiency. As is understood from the graph, both the luminance and the luminous efficiency are increased as the minor axis in the cross-section of the glass tube is reduced. However, the luminance and the luminous efficiency change only a little when the ratio of the minor axis to the major axis is reduced to less than 0.2. Accordingly, it is understood that the ratio of the major axis to the minor axis is preferably in the range of 10:7 to 5:1.

In the display according to the present invention, the size of the entire display area is determined by adjusting the number of discharge tubes and the length thereof. Since the display is of an AC surface-discharge type, in which wall charges accumulate on the inner surface of the discharge tubes 10, it is important that the discharge tubes 10 be optimally designed. In the discharge tubes having a flattened elliptical shape in cross-section as described above, in order that surface discharge occurs between display electrodes formed on one of the flat portions, the wall thickness of the discharge tubes is preferably set to 400 $\mu$m or less.

Second Embodiment

Figure 2:
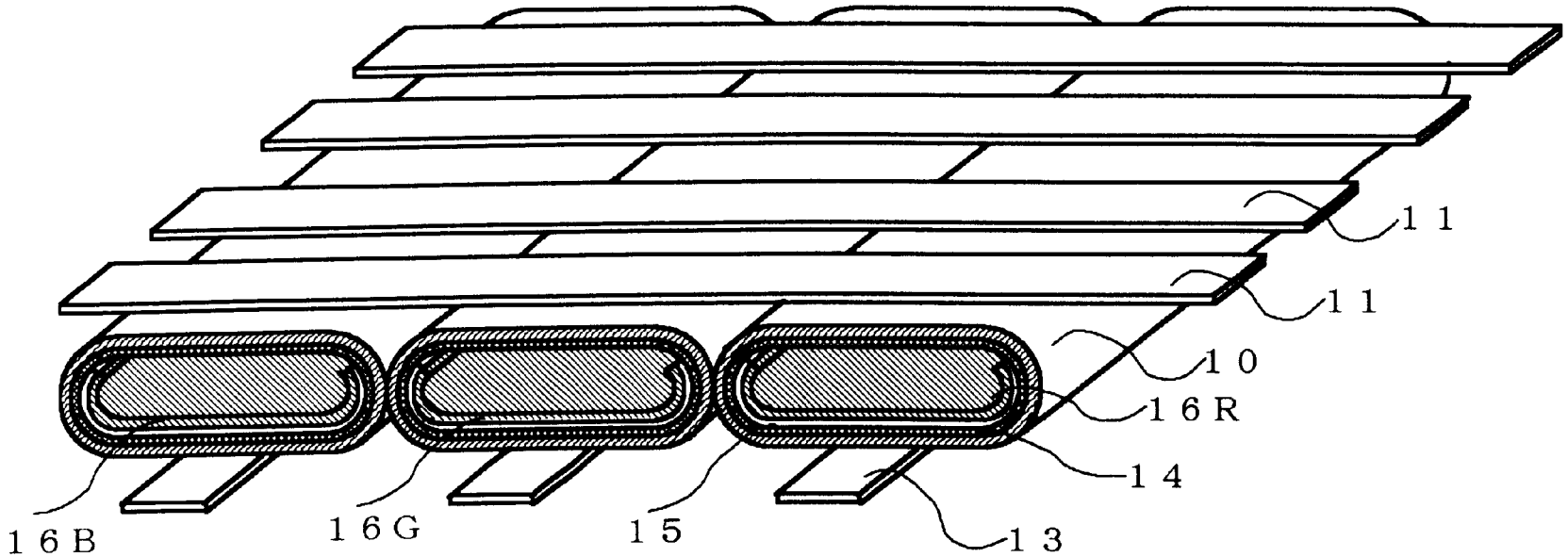
FIG. 2 is a perspective view of a display including discharge tubes according a second embodiment of the present invention.

FIG. 2 is a perspective view of a display including discharge tubes according to a second embodiment of the present invention. In FIG. 2, a blue fluorescent phosphor 16B, a green fluorescent phosphor 16G, and a red fluorescent phosphor 16R are contained in three successive discharge tubes. Except for this, the discharge tubes 10 shown in FIG. 2 have the same construction as those shown in FIGS. 1A to 1C. A light emitting unit is formed at each intersection of pairs of display electrodes 11, which serve as discharge electrodes, and the data electrodes 13, and three light emitting units corresponding to blue, green, and red form a single pixel. The display is constructed by arranging a plurality of pixels in an array.

Third Embodiment

Figure 3A:
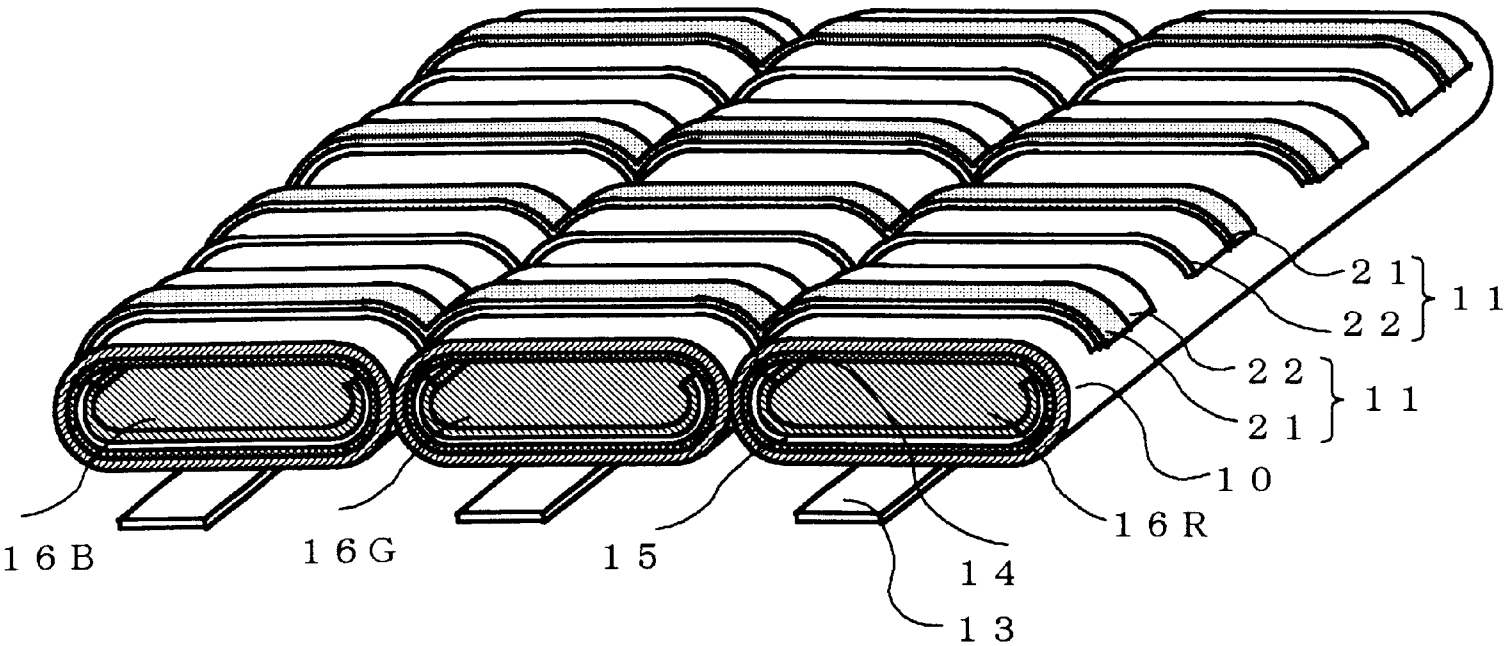
FIGS. 3A and 3B are diagrams showing a display including discharge tubes according to a third embodiment of the present invention.
Figure 3B:
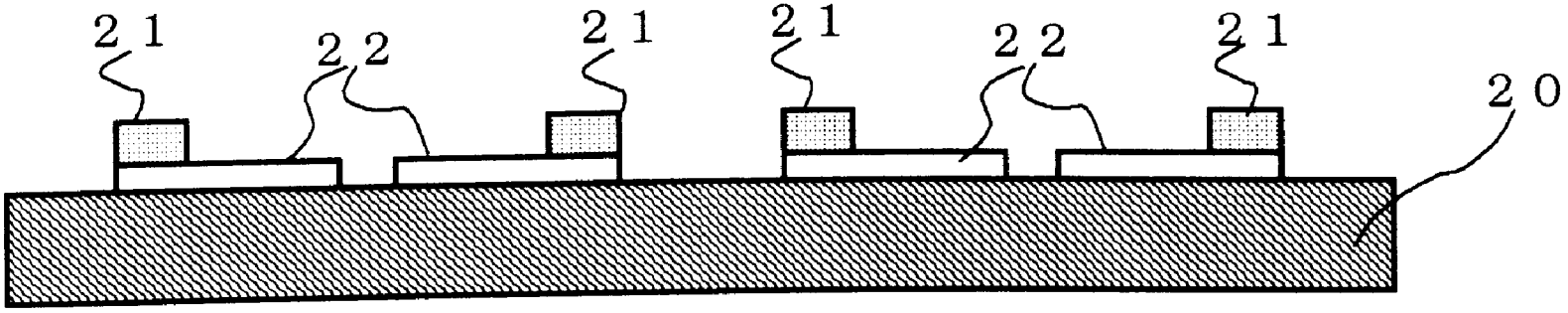

FIGS. 3A and 3B show a display including discharge tubes according to a third embodiment of the present invention. As shown in FIG. 3A, the discharge tubes of the present embodiment are constructed and arranged similarly to the discharge tubes of the second embodiment, and explanations thereof are thus omitted. According to the present embodiment, as shown in FIG. 3B, the display electrodes 11, each of which is constructed of a metal electrode 21 and a transparent electrode 22, are formed on a transparent film 20 in advance. Then, the transparent film 20, on which the display electrodes 11 are formed, is disposed on the glass tubes along the external surfaces thereof. Although not shown in FIG. 3A, the transparent film 20 is fixed on the glass tubes at the upper side thereof. In this case, the transparent film 20 may also be formed as a filter that can block near infrared rays. In addition, more preferably, a black strip of film is formed between each scanning electrode and common electrode pair in advance. The transparent electrodes 22 may be formed of an inorganic material such as ZnO, ITO, etc., or may be formed of an organic conductor. The metal electrodes 21 may be formed of a metal material having a low resistance, for example, Cu, Ag, etc. In the present embodiment, since a heating process is not required after the electrodes are formed, there is a large amount of freedom in choosing the material.

In addition, in the present embodiment, the electrodes are formed along the external surfaces of the glass tubes, so that discharge area can be increased. Thus, the brightness and the luminous efficiency can be further increased.

Fourth Embodiment

Figure 4:
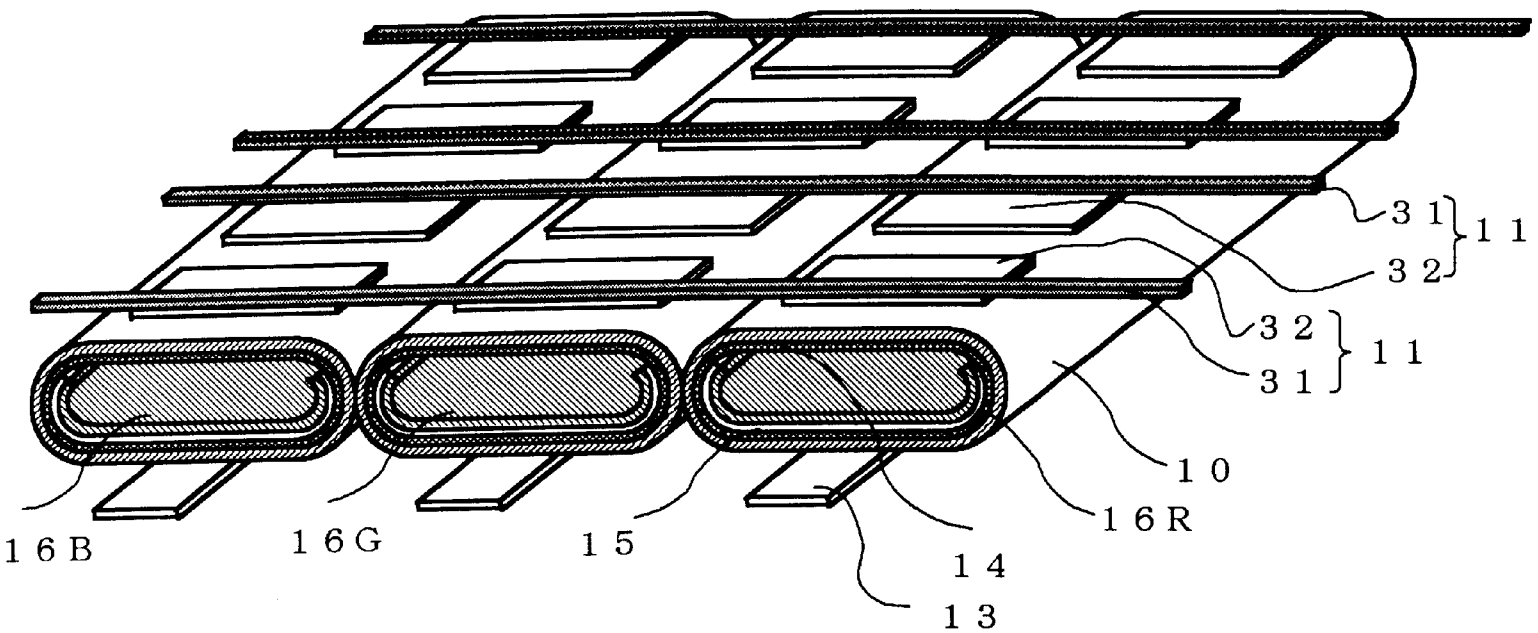
FIG. 4 is a perspective view of a display including discharge tubes according to a fourth embodiment of the present invention.

FIG. 4 is a perspective view of a display including discharge tubes according to a fourth embodiment of the present invention. The discharge tubes of the present embodiment are constructed and arranged similarly to the discharge tubes of the second embodiment, and explanations thereof are thus omitted. In the present embodiment, auxiliary electrodes 32 are formed only on the flat portions of the glass tubes, so that the capacitance between each pair of the display electrodes 11 can be reduced. In FIG. 4, metal electrodes 31 which extend linearly are shown. However, as described in the third embodiment, the auxiliary electrodes 32 and the metal electrodes 31 may first be formed on a sheet (not shown), and then disposed along the external surfaces of the glass tubes by using lamination, adhesion, welding, etc. The auxiliary electrodes 32 may be formed of the transparent materials mentioned above in the third embodiment.

What is claimed is:

1. An AC-type gas discharge display comprising:

a base;

a plurality of discharge tubes which are arranged on the base in parallel to each other and which contain fluorescent phosphors;

data electrodes formed on the external surfaces of the discharge tubes such that the data electrodes extend in the longitudinal direction of the discharge tubes; and display electrodes formed in pairs, in each of which one display electrode serves as a scanning electrode and the other display electrode serves as a common electrode, on the exterior surfaces of the discharge tubes at the opposite side from the data electrodes such that the display electrodes intersect the discharge tubes, wherein each of the discharge tubes has a flattened elliptical shape in cross-section thereof and includes a pair of flat portions, wherein the data electrodes are formed on one of the flat portions and the scanning electrodes and the common electrodes are alternately arranged on the other one of the flat portions, and the discharge tubes are supported by the base at one or the other one of the flat portions.

2. An AC-type gas discharge display according to claim 1, wherein the wall thickness of each discharge tube is 400 $\mu$m or less at least at one of the flat portions and a gas discharge occurs between adjacent pairs of display electrodes in each discharge tube via the corresponding part of the wall.

3. An AC-type gas discharge display comprising:

a discharge tube into which discharge gas is filled, which is provided with at least one pair of display electrodes on the external surface thereof, which includes a fluorescent phosphor layer superposed on the internal surface thereof, and which emits light when a voltage is applied to the pair of display electrodes and a gas discharge occurs therein, wherein the discharge tube has an elliptical shape in cross-section thereof, and the display electrodes are disposed on the external surface of the discharge tube such that the display electrodes extend in the direction of the major axis of the elliptical shape.

4. An AC-type gas discharge display according to claim 3, wherein at least a part of the discharge tube is formed as a flat portion and the display electrodes are formed on the flat portion of the discharge tube.

5. An AC-type gas discharge tube according to claim 3, wherein the discharge tube includes a pair of flat portions which, in cross sectional view, extend in the direction of the major axis of the elliptical shape while opposing each other.

6. An AC-type gas discharge tube according to claim 3, wherein, in the cross-section of the discharge tube, the ratio of the major axis to the minor axis is in the range of 10:7 to 5:1.

7. An AC-type gas discharge tube according to claim 3, wherein the fluorescent phosphor layer is formed on a fluorescent phosphor layer supporter, and the fluorescent phosphor layer supporter is disposed within the discharge tube.

8. An AC-type gas discharge tube according to claim 4, wherein the discharge tube includes a pair of flat portions which, in cross sectional view, extend in the direction of the major axis of the elliptical shape while opposing each other.

9. An AC-type gas discharge tube according to claim 4, wherein, in the cross-section of the discharge tube, the ratio of the major axis to the minor axis is in the range of 10:7 to 5:1.

10. An AC-type gas discharge tube according to claim 4, wherein the fluorescent phosphor layer is formed on a fluorescent phosphor layer supporter, the fluorescent phosphor layer supporter is inserted into the discharge tube, and the fluorescent phosphor layer supporter is disposed on opposed side to the flat portion.

11. An AC-type gas discharge tube according to claim 5, wherein, in the cross-section of the discharge tube, the ratio of the major axis to the minor axis is in the range of 10:7 to 5:1.

12. An AC-type gas discharge tube according to claim 5, wherein the fluorescent phosphor layer is formed on a fluorescent phosphor layer supporter, and the fluorescent phosphor layer supporter is disposed within the discharge tube.

13. An AC-type gas discharge tube according to claim 5, wherein the fluorescent phosphor layer is formed on a fluorescent phosphor layer supporter, and the fluorescent phosphor layer supporter is disposed within the discharge tube.

14. An AC-type gas discharge tube according to claim 6, wherein the fluorescent phosphor layer is formed on a fluorescent phosphor layer supporter, and the fluorescent phosphor layer supporter is disposed along a inside of the discharge tube.

15. An AC-type gas discharge tube according to claim 8, wherein the fluorescent phosphor layer is formed on a fluorescent phosphor layer supporter, and the fluorescent phosphor layer supporter is disposed within the discharge tube.

16. An AC-type gas discharge tube according to claim 11, wherein the fluorescent phosphor layer is formed on a fluorescent phosphor layer supporter, and the fluorescent phosphor layer supporter is disposed along a inside of the discharge tube.

17. An AC-type gas discharge tube according to claim 12, wherein the fluorescent phosphor layer is formed on a fluorescent phosphor layer supporter, the cross sectional shape of the fluorescent phosphor layer supporter is including a flat portion and curved portions formed at both sides thereof, and the fluorescent phosphor layer supporter is inserted into the discharge tube.

18. An AC-type gas discharge display, comprising: a base;

a plurality of discharge tubes arranged on the base in parallel to each other and which contain fluorescent phosphors;

data electrodes formed on external surfaces of the discharge tubes, extending in a longitudinal direction of the discharge tubes; and display electrodes arraged in pairs and formed on a film, in each pair of which one display electrode serves as a scanning electrode and the other display electrode serves as a common electrode, on the exterior surfaces of the discharge tubes at the opposite side thereof from the data electrodes and such that the display electrodes intersect the discharge tubes, wherein:

each of the discharge tubes has a flattened elliptical shape in cross-section and includes a pair of flat portions, and the data electrodes are formed on one of the flat portions and the scanning electrodes and the common electrodes are alternately arranged on another one of the flat portions, and the discharge tubes are supported by the base at the one, or the other, of the flat portions.

19. An AC-type gas discharge display according to claim 18, wherein the film serves to block near infrared rays from the discharge tubes.

20. An AC-type gas discharge display according to claim 18, wherein the firm is transparent.

* * * * *

UNITED STATES PATENT AND TRADEMARK OFFICE

CERTIFICATE OF CORRECTION

PATENT NO. : 6,677,704 B2
DATED : January 13, 2004
INVENTOR(S) : Manabu Ishimoto et al.

It is certified that error appears in the above-identified patent and that said Letters Patent is hereby corrected as shown below:

Column 5,
Line 56, change ". the" to -- a first side of --;
Line 57, after "tubes" insert -- , -- and change "such that the data electrodes extend" to -- extending --.
Line 58, change "the" (first occurrence) to -- a --;
Line 59, change "formed" to -- arranged -- and after "each" insert -- pair --;
Line 62, after "on" insert -- a second side of -- and after "tubes" insert -- , -- and delete "at the".
Line 63, after "opposite" insert -- the first -- , delete "from the data electrodes" and before "such" insert -- and --;
Line 64, after "tubes," insert -- wherein: --;
Line 65, delete "wherein";
Line 66, change "and includes" to -- , including --;
Line 67, after "portions," insert -- and --.

Column 6,
Line 1, delete "wherein";
Line 5, change "one or the other one" to -- one, or the other, --;
Line 7, change "the wall" to -- a -- and before "each" insert -- a wall of --;
Line 10, change "the corresponding" to -- a corresponding --;
Line 14, change "the external" to -- an external --;
Line 15, change "the internal" to -- an internal --;
Line 16, after "thereof" insert -- , --;
Line 19, after "shape in" insert -- a --;
Line 22, change "the direction" to -- a direction --;
Line 23, change "the major" to -- a major --.

Column 7,
Line 14, change "a inside of" to -- an inside surface of --;
Lines 19-20, change "is including " to -- includes --;
Line 23, begin a new paragraph with "a base".

UNITED STATES PATENT AND TRADEMARK OFFICE

CERTIFICATE OF CORRECTION

PATENT NO. : 6,677,704 B2
DATED : January 13, 2004
INVENTOR(S) : Manabu Ishimoto et al.

It is certified that error appears in the above-identified patent and that said Letters Patent is hereby corrected as shown below:

Column 8,
Each of the paragraphs from lines 12-13 and 14-18 should be subparagraphs.

Signed and Sealed this

Sixth Day of April, 2004

JON W. DUDAS
*Acting Director of the United States Patent and Trademark Office*